United States Patent [19]

Smith

[11] Patent Number: 5,016,860

[45] Date of Patent: May 21, 1991

[54] "NO-NICK" PART-HANDLING APPARATUS AND METHOD

[75] Inventor: John W. Smith, Brighton, Mich.

[73] Assignee: Holcroft Inc., Livonia, Mich.

[21] Appl. No.: 472,978

[22] Filed: Jan. 31, 1990

[51] Int. Cl.[5] ..... C21D 1/62

[52] U.S. Cl. ..... 266/112; 266/259

[58] Field of Search ..... 266/112, 105, 259; 148/153, 155; 432/85, 80, 77

[56] References Cited

U.S. PATENT DOCUMENTS

| | | | |
|---|---|---|---|
| 3,381,947 | 5/1968 | Beggs | 266/259 |
| 3,599,946 | 8/1971 | Westeren et al. | 148/153 |
| 3,659,831 | 5/1972 | Reber et al. | 148/153 |

*Primary Examiner*—S. Kastler

*Attorney, Agent, or Firm*—Herbert E. Messenger

[57] ABSTRACT

Disclosed is a part-handling apparatus for a heat-treating furnace system and its use in transferring parts such as bearing races into, through, and out of a quench tank while avoiding any part-to-part contact and thus preventing nicking of parts. The apparatus includes a charge elevator formed of closely-spaced rails divided into lanes and which lowers parts into a quench fluid. A walking beam system for moving parts along the tank has movable rails which mesh with stationary rails and with the rails of the charge and discharge elevators when the elevators are located in their lowermost positions and includes a frame which is movable vertically and longitudinally. A push-off device near the tank discharge end pushes parts from the discharge elevator either directly onto an in-line conveyor of a washer or tempering furnace or onto a rotatable arm which alters the travel path of the parts a selected angle such as 90 degrees before delivering the parts to the conveyor of the washer to temper furnace.

13 Claims, 6 Drawing Sheets

"NO-NICK" PART-HANDLING APPARATUS AND METHOD

BACKGROUND OF THE INVENTION

This invention relates to a method and apparatus for moving heat-treated parts into, through, and out of a fluid-containing tank while avoiding nicking of parts. In particular, the invention relates to the movement of parts into, through, and out of a quench or cooling tank of a continuous furnace hardening or carburizing system while preventing any part-to- part contact.

Existing continuous hardening furnace systems typically include a hardening furnace, a quench press whose operation includes initial quenching, a secondary quenching or cooling tank for core cooling, a washer (if required), and a tempering furnace. Parts which are processed through these systems are usually charged into, and transported through, the hardening furnace on trays, then are unloaded from the trays and moved through the remaining furnace system stages. The parts are moved from stage to stage automatically by a variety of mechanisms.

With many of the parts that are processed in hardening furnace systems, such as bearing races, it is very important that all part-wearing surfaces remain smooth. If during processing physical damage (nicking) occurs on a wearing surface to a depth greater than the amount of material to be removed from the wearing surface by subsequent finish grinding operations, the part has to be rejected. A problem with known hardening furnace systems is that at various stages parts can come into contact with one another, resulting in part nicking. Due to the need to reject many of such nicked parts, part nicking can dramatically impair the productivity of the furnace system.

In general, since parts are contained on trays until being discharged from the hardening furnace they remain separated and hence are not prone to nicking due to part-to-part contact. From the point of unloading and onward, however, part-to-part contact and the accompanying nicking became a concern.

In typical hardening furnace systems the transfer of parts from the quench press to the secondary quench tank or cooling tank requires a drop in elevation of the parts. Known hardening furnace systems simply allow the heat-treated parts to fall freely the necessary distance to transfer the parts from the quench press to a conveyor at the bottom of the secondary quench tank. Clearly, with such a practice, there is a high probability of falling parts coming into contact with one another and with the downstream parts below.

Once parts reach the bottom of the quench tank of prior art hardening furnace systems, the parts are directed through the quenching liquid (e.g., oil or water) by means of an upwardly-sloped conveyor which moves the parts to the top of the tank in preparation for transfer of the parts to a washer or a temper furnace. There is then another free fall and further risk of nicking when the parts are delivered from the secondary quench tank to a conveyor leading to the washer or temper furnace.

It is therefore an object of the present invention to provide apparatus for avoiding part-to-part contact, and hence part nicking, in a portion of a furnace system.

It is also an object of the present invention to decrease the part reject rate of hardening furnace systems by reducing part nicking.

It is yet another object of the invention to provide a method and apparatus by which heat-treated metal parts are moved into, through, and out of a secondary quench tank of a hardening furnace system while avoiding part-to-part contact.

SUMMARY OF THE INVENTION

Part nicking problems which are associated with known continuous hardening furnace systems are greatly alleviated by the apparatus and method of the present invention which provide for the transport of parts into, through, and out of a secondary quench tank or cooling tank while avoiding any Part-to-part contact.

The invention includes a charge elevator at one end of a quench tank for receiving parts from a quench press and gradually lowering the parts on rails into liquid held in the tank while maintaining separation between adjacent and successive parts and avoiding tipping of parts. Free fall, and risk of part-to-part contact, are prevented in the transfer of parts from the quench press to the quench tank.

The part-handling apparatus also includes a walking beam near the bottom of the tank to move parts along the length of the tank through the quench liquid without part-to-part contact. A discharge elevator is provided at the outlet end of the quench tank to raise parts for transfer from the tank to a conveyor of a washer or tempering furnace adjacent to the quench tank.

In accordance with the present invention a charge elevator, a discharge elevator, and a "walking beam" system are formed with finger-like rails parallel to the longitudinal axis of the quench tank, with movable rails being meshable with rails of the elevators and with stationary rails extending along the bottom of the tank between the elevators. The rails, which may be constructed of flat steel bars set vertically on edge, are closely spaced to support a range of sizes of parts. Preferably the rails include containment tabs at spaced intervals on their upper surfaces to prevent longitudinal movement of parts along the rails. Lane dividers may also be provided to separate groups of rails into lanes, preventing lateral movement of parts and thus part-to-part contact.

After the charge elevator descends with a part in each of its multiple lanes, its rails mesh with rails of the movable walking beam system. Upward movement of a walking beam mechanism or movable frame gently transfers parts to the movable rails, and subsequent longitudinal, downward, longitudinal, and upward movements of the movable frame "walk" the parts along the stationary rails to the discharge elevator. Following their transfer onto the rails of the discharge elevator, the parts are raised to a level at or above the top of the quench tank.

In one embodiment of the invention parts are pushed from the rails of the discharge elevator (while in their raised position) directly onto the conveyor of a washer or temper furnace "in-line" with the rails. In an alternate embodiment the conveyor of the washer or temper furnace has its longitudinal axis offset by an angle such as 90 degrees to the longitudinal axis of the quench tank, as to better utilize available space. To transfer the parts to this conveyor, a pusher first moves the parts from the rails of the discharge elevator to a rotatable arm. The arm is then rotated substantially horizontally through an arc equivalent to the angle, after which hinged trapdoor members in the arm are triggered to release. Parts gently slide along the trap doors down onto the conveyor, then the trap doors are retracted and the arm returned to its initial position to receive additional parts.

BRIEF DESCRIPTION OF THE DRAWING

The invention is described in more detail hereinafter with reference to the following figures of the drawing in which like numerals refer to like elements.

DETAILED DESCRIPTION OF PREFERRED EMBODIMENTS

The part-handling method and apparatus of the invention avoids "free fall" delivery of parts to a quench tank by providing a charge elevator for receiving parts from a quench press and gently lowering them into the tank. (The terms "quench tank" and "cooling tank" are used herein to refer to a tank or other container for holding a liquid such as oil or water to provide secondary quenching or cooling of parts immersed in the liquid. The liquid functions to reduce the temperature of parts, particularly their core portions, to levels appropriate for delivery to a washer or a temper furnace). The apparatus also includes a walking beam system for transporting parts through the quench tank while preventing either lateral or longitudinal part-to-part contact and for delivering the parts to a discharge elevator. Parts are removed from the quench tank by the discharge elevator, and the parts then are delivered either directly to the conveyor of an "in-line" washer or temper furnace or to a rotatable arm device which rotates and deliver the parts to a conveyor positioned at a selected angle from the in-line direction of travel.

Figure 1:
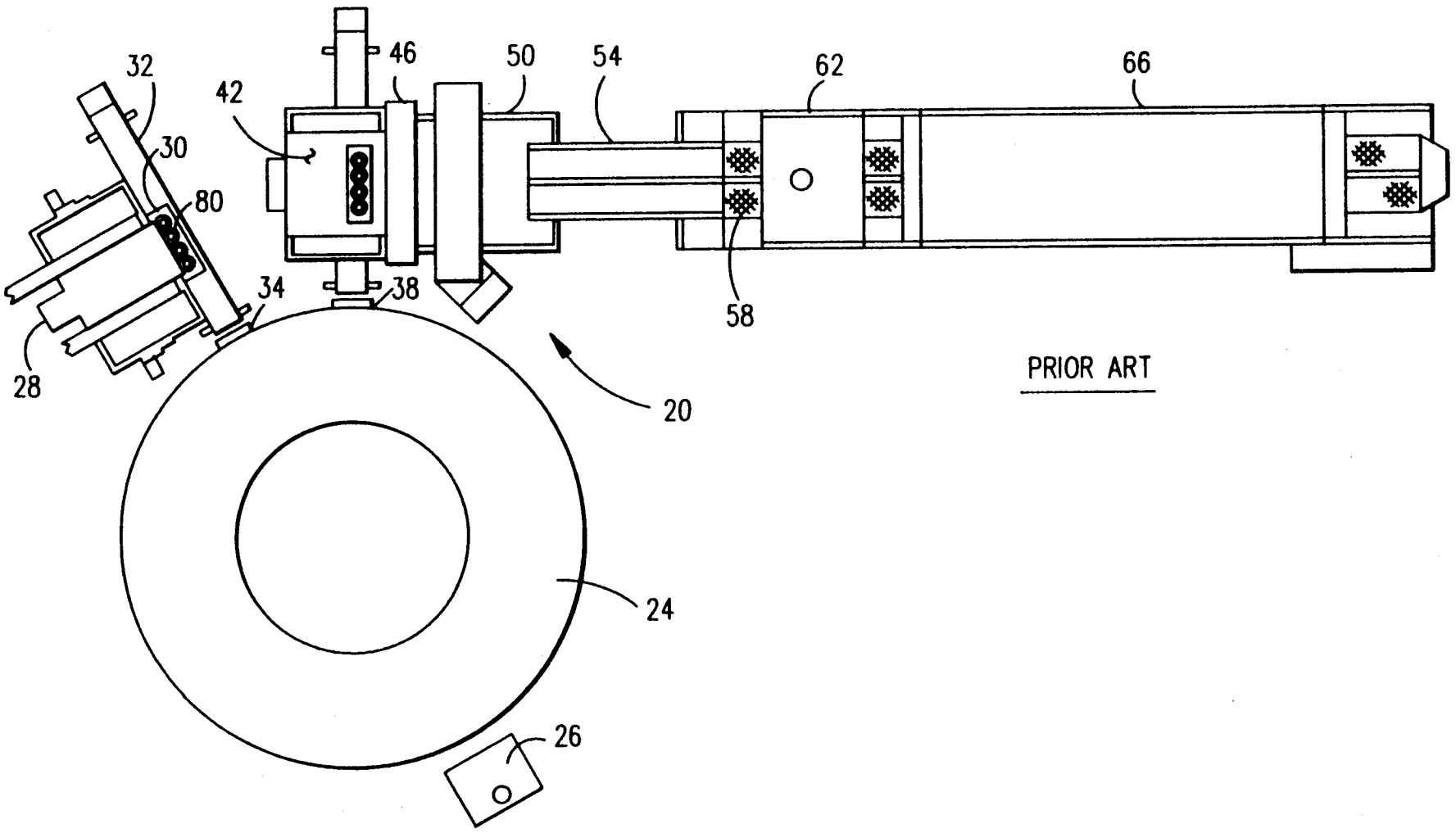
FIG. 1 is a plan view of a prior art rotary hearth hardening furnace system illustrating principal components with which the part-handling apparatus of the present invention may be used.

In FIG. 1 there is shown a typical prior art furnace system 20 of the type with which the part-handling apparatus of the present invention can be used. The furnace system includes a heat-treating furnace 24 which may be a hardening furnace or a carburizing furnace, and which by way of example is a rotary hearth hardening furnace driven by a hearth drive 26. At a specified location on the periphery of the furnace 24 a tray loader 28 is provided for loading trays 30 of parts such as bearing races onto a furnace loader 32 which delivers the trays 30 through a charge door 34 into the furnace 24. After parts are heat-treated at a controlled temperature and atmosphere in the rotary furnace 24, the trays of parts are removed through a discharge door 38 and a tray unloader 42 unloads parts from the trays 30. Parts are then transferred to a quench press 46, and after the pressing operation is complete the parts are delivered to a quench tank 50. Delivery to the quench tank 50 is typically effected by a tray unloader 42 which simply pushes the parts off a platen of the quench press 46 so that the parts fall freely to the bottom of the quench tank 50.

The quench tank 50 contains oil or water to a selected depth and also has an inclined conveyor 54 to transport parts along the quench tank 50 and to raise the parts to a position above the surface of the fluid. From that position the parts are again allowed to freely fall onto a conveyor 58 which transports the parts to and through a washer 62 and a tempering furnace 66.

The free fall and landing of parts in the charge end of the quench tank 50, and later onto the washer conveyor 58 often results in part nicking from part-to-part contact. To a lesser extent, part-to-part contact and part nicking can occur as the parts are transported by the conveyors 54 and 58. A primary object of the present invention is to avoid any part-to-part contact, and thus part nicking, during movements equivalent to the above-indicated transport of the parts in a continuous furnace system.

Figure 2:
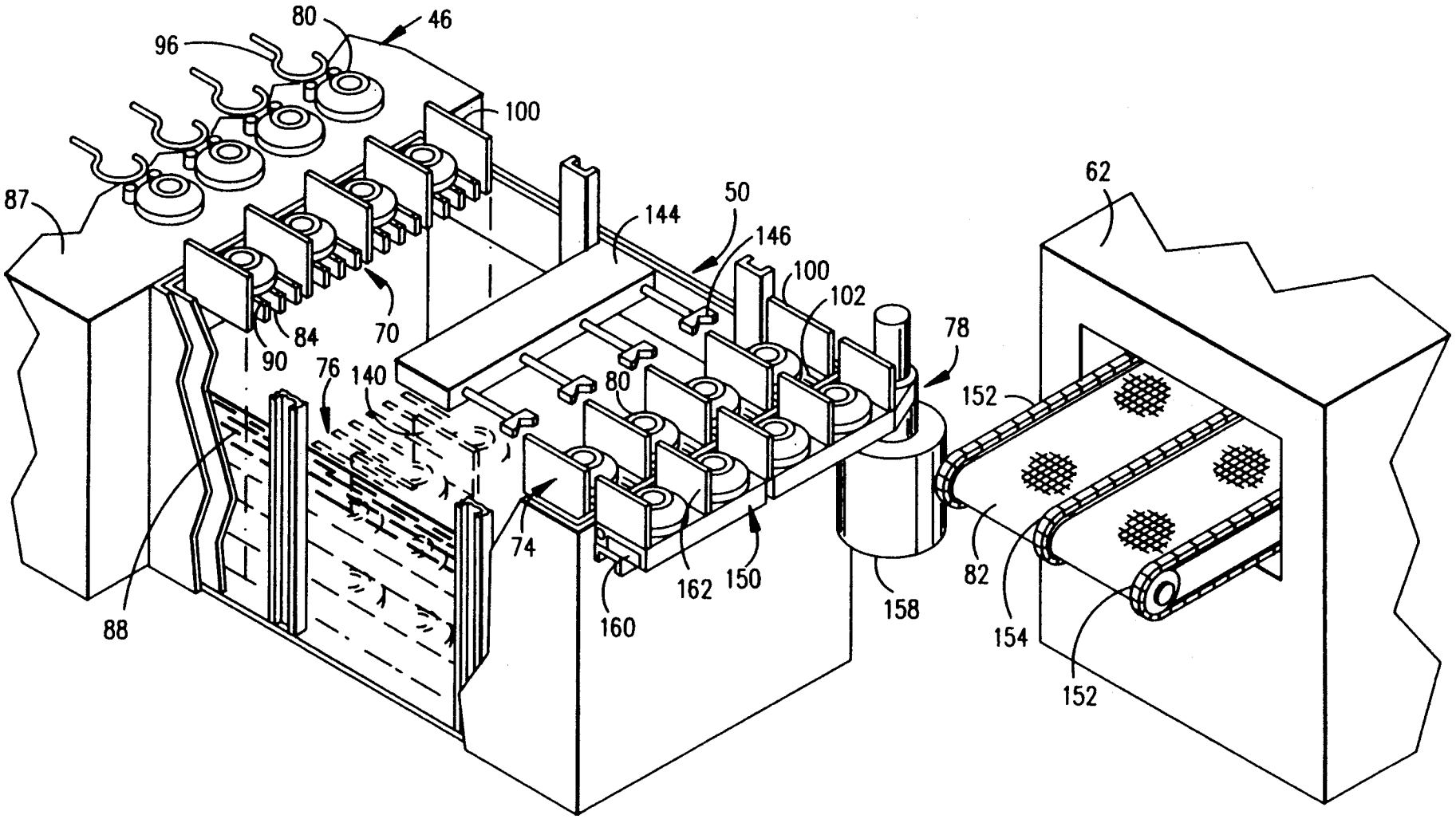
FIG. 2 iS a perspective view of a preferred part-handling apparatus in accordance with the present invention for delivery of parts from a quench press to and through a secondary quench tank and to a conveyor of a washer or tempering furnace.

FIG. 2 is a perspective view of a preferred no-nick part-handling apparatus according to the present invention, with certain lift and lower mechanisms not shown (for ease and clarity of illustration). The apparatus includes a charge elevator 70 mounted within the quench tank 50 at a Part-receiving end adjacent to a quench press 46, a discharge elevator 74 mounted at the discharge end of the quench tank 50, a "walking beam" system 76 for moving parts along the quench tank between the elevators 70 and 74, and a rotatable arm device 78 for transferring parts 80 such as bearing races from the discharge end of the quench tank 50 to a conveyor 82 of a washer or temper furnace 62. (The conveyor 82 illustrated in FIG. 2 is out-of-line by 90 degrees from the longitudinal axis of the quench tank 50, an arrangement of components which may provide efficient overall use of floor space).

The charge elevator 70 functions to receive parts 80 from the quench press 46 and to lower the parts into the fluid of the quench tank 50 while preventing part-to-part contact. For this purpose the elevator 70 includes several generally horizontal charge rails 84 or fingers which extend parallel to the "in-line" travel path of parts from the quench press 46 and along the length of the quench tank 50. The charge rails 84 are connected to a lift/lower device 86 (FIG. 3) such as an air cylinder mechanism, or a motor-driven chain system, which lowers and lifts the rails 84 between a first level even with an unload surface 87 of the quench press 46 and a second level near the bottom of the tank at which the parts are submerged in the oil or other cooling/quench fluid 88.

The charge rails 84 may be formed of flat steel bars - for example, three-sixteenths-inch bar stock set on edge and joined by a transverse rail at their ends adjacent to the quench tank 50. A typical spacing of the charge rails 84 is about ¾ inch apart on centers. (Close spacing of the rails 84 of both elevators 70 and 74, and of the rails of the walking beam 76 with which the elevators mesh, allows the parts 80 to be supported by at least two (and preferably three) rails at all times during residence in the quench tank 50, thereby reducing the risk of tipping of the parts 80). The ends of charge rails 84 remote from the quench press 46 desirably have containment tabs 90 or raised portions (see FIG. 2) which act as stops for parts loaded onto the rails 84 by action of pushers such as Shepherd's crook-shaped pusher heads 96. Also, upwardly-extending lane dividers 100 parallel to the longitudinal direction of the charge rails 84 separate the rails 84 into groups to form separate travel paths for individual parts received by the charge elevator 70, thus avoiding part-to-part contact due to lateral movement of the Parts 80.

In one alternate furnace system arrangement (not shown) the greater transverse spacings required for parts when positioned in the quench press relative to part spacings in the tray unloader which precedes the quench press results in parts being pushed from the tray unloading area toward the quench Press at angles to the longitudinal axis of the quench tank in order that the parts move to the appropriate locations in the press. Thereafter, when the parts are pushed from the press along an extension of the same angled path to the charge elevator, the parts reach positions at which they are spaced over a greater width than needed for travel through the quench tank. Hence a cross pusher mechanism is then employed to move the parts transversely inward to positions on the charge elevator appropriate for travel through the quench tank. In this arrangement lane dividers are not included as part of the charge elevator.

The discharge elevator 74 at the discharge end of the quench tank is similar in structure to the charge elevator 70, and lane dividers 100 (similar to those provided for the charge rails 84) separate the discharge rails into lanes. The rails 102 of the discharge elevator 74 are moved, by operation of a lift/lower device 104 (FIG. 3) similar to that associated with the charge rails 84, between a level near the bottom of the tank 50 and a level slightly above the top of the tank and from which parts 80 may be moved out of the tank and onto the conveyor 82 of the washer or temper furnace 62 (washer is not required if water is the fluid utilized in the quench tank 50).

Movements of the Shepherd's crook-shaped pusher heads 96 and the charge rails 84 are synchronized so that as soon as Parts 80 have been loaded onto the charge rails 84 the rails are moved toward the bottom of the quench tank 50. Near the bottom of the quench tank 50 the rails 84 mesh with movable walking beam rails 106 (FIG. 4) in a manner which is set forth in greater detail below. This meshing action assists in the transfer of parts 80 from the charge rails 84 to the movable walking beam rails 106. The parts 80 are then transported along the tank 50 through the quench fluid to the discharge elevator 74 by movement of the movable rails 106. The structure of the walking beam 76 system and its interaction with the charge and discharge elevators 70 and 74 are set forth in greater detail below.

Figure 4:
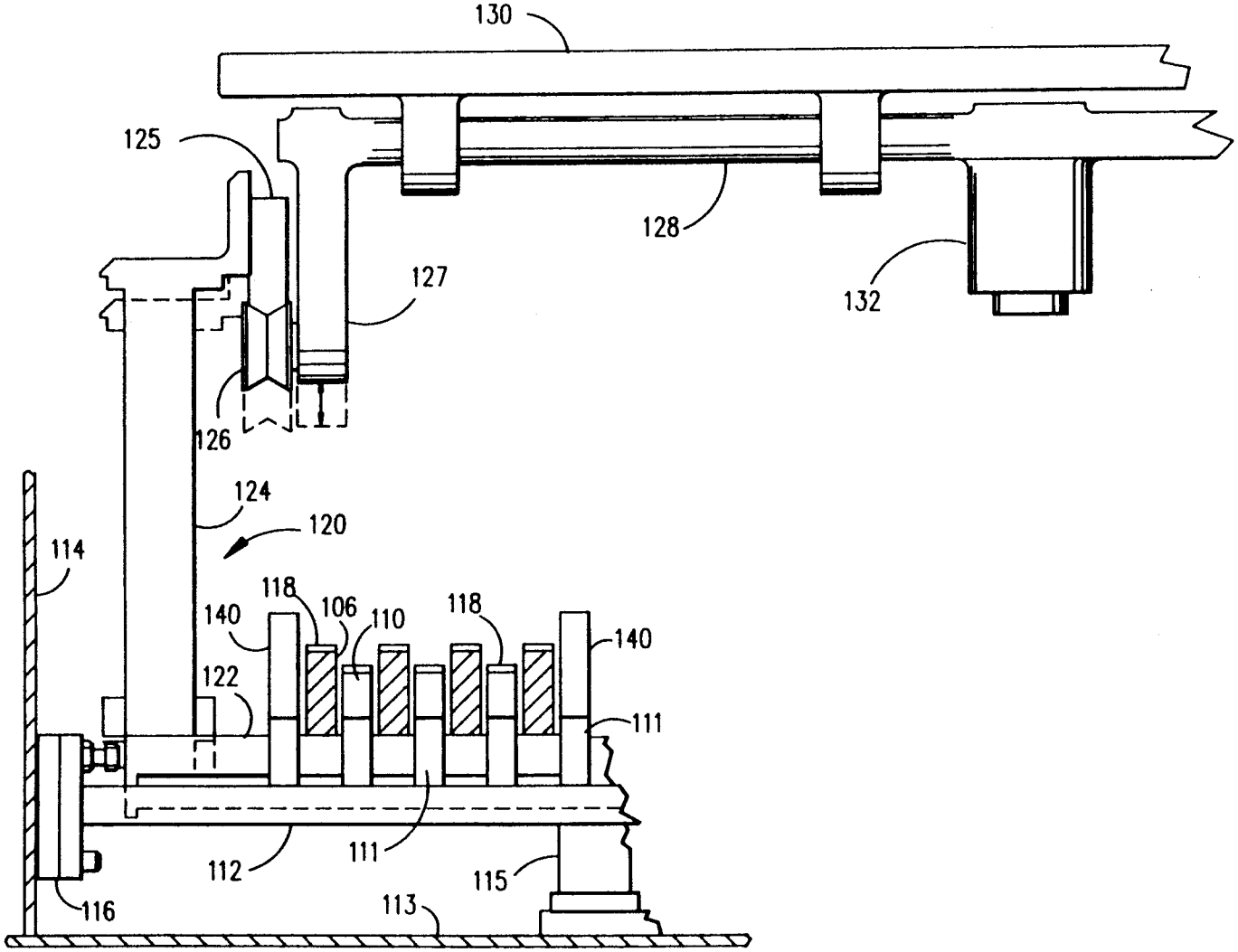
FIG. 4 is an elevational view in cross-section of a portion of the part-handling apparatus taken along the line 4—4 of FIG. 3.

As is evident in FIG. 4, major components of the walking beam system 76 are the movable rails 106 and a set of stationary rails 110. Both sets of rails 106 and 110 are arranged parallel to the charge rails 84 and the discharge rails 102 and desirably have inter-rail spacings similar to those of the elevator rails 84 and 102. The stationary rails 110 may be "in-line" with the elevator rails, and the movable rails 106 may be offset one-half an inter-rail gap from the elevator rails 84, 102 so that the movable rails 106 readily "mesh" with the elevator rails 84,102 and the stationary rails 110 as the movable rails 106 are lifted and lowered.

Figure 5:
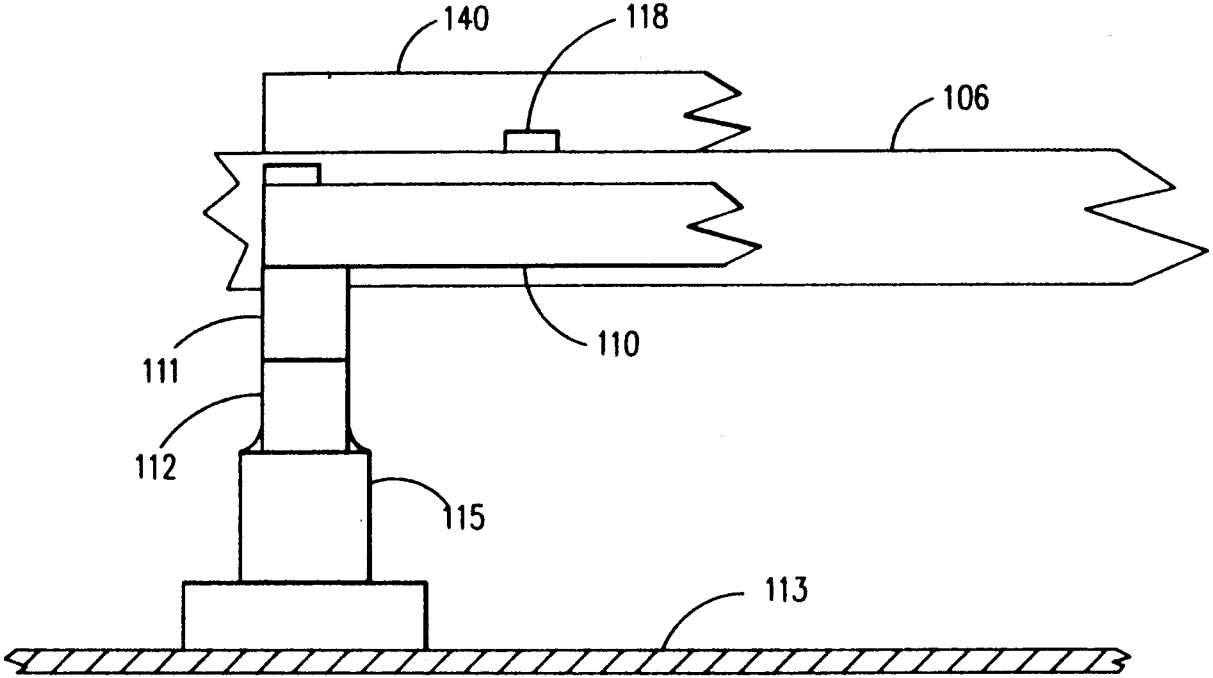
FIG. 5 is a partial side-elevational view of the quench tank of the part-handling apparatus taken along the line 5—5 of FIG. 3.

As shown in FIGS. 4–5, each stationary rail 110 may be supported near the charge and discharge ends of the quench tank 50 by plates 111 connected to the bottom of each rail 110 and which extend only part-way along the length of the tank 50 so as not to interfere with movement of the movable frame 120 (described below). A plate 111 is connected to the bottom of each rail 110 and the plates 111 are connected to and supported by transverse members 112, one near each end of the tank 50. The members 112 are rigidly attached to the bottom wall 113 and side wall 114 of the tank by supports 115 and 116 respectively.

Also provided on both the movable rails 106 and the stationary rails 110 are tabs 118 positioned at fixed intervals (e.g., every eight inches) along the length of the rails. The tabs 118 extend upward from the tops of the rails 106, 110 to create "pockets" within each of which an individual part may be retained and restricted from longitudinal sliding movement along the rails.

Figure 3:
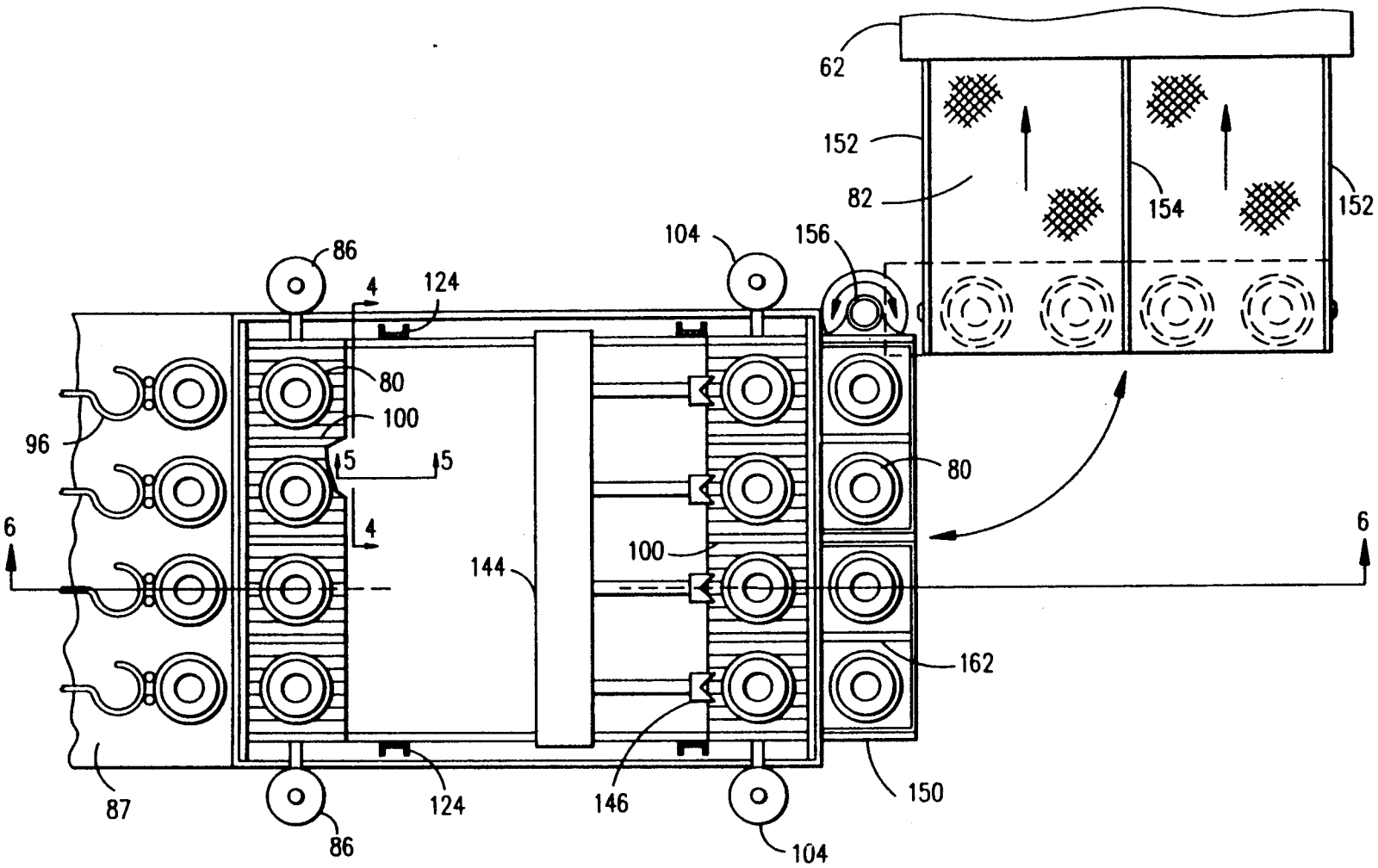
FIG. 3 is a plan view of the part-handling apparatus of FIG. 2, with top portions of the walking beam mechanism omitted for clarity.

For ease and clarity of illustration, FIGS. 2–4 show just three charge rails 84, discharge rails 102, and stationary rails 110 per lane—e.g., between adjacent lane dividers, and just four movable rails 106 per lane. It should be understood, however, that many more rails (e.g. a dozen or more per lane) may be provided so as to facilitate handling of parts of different sizes while minimizing the risk of tipping of parts during their transport.

As best illustrated in FIG. 4, the movable rails 106 are supported by, and connected to, a movable rail frame 120 forming part of the walking beam system 76. As indicated in FIG. 4, which shows the movable frame 120 and rails 106 in their "up" position, the frame 120 includes one or more (preferably at least two) horizontal members 122 extending across the lower portion of the tank 50 and also includes vertical members 124 near opposed tank side walls 114 and which extend upward to a level above the fluid in the quench tank 50. To provide lifting and lowering of the movable rail frame 120 and its associated rails 106, a plate 125 near the top of the frame 120 and having a V-shaped lower end interacts with a V-grooved roller 126 attached to a crank arm 127 extending downward from one end of a rotatable shaft 128 (a similar crank arm and roller are provided at the opposite end of the shaft 128). The shaft 128 is supported from a fixed top frame 130 and is rotatably driven (through a partial revolution) by action of a hydraulic cylinder 132. Because the hydraulic cylinder 132 is attached to a fixed structural member of the apparatus, essentially pure vertical motion of the movable frame 120 is produced as the crank arm 127 is rotated. The hydraulic cylinder 132 may also drive a second rotatable shaft extending transversely across the tank at a longitudinal position spaced from that of the shaft 128, the second shaft (not shown) being tied by tension rods to the shaft 128 and interacting through a pair of crank arms and rollers similar to those shown in FIG. 4.

Longitudinal movement of the frame 120 (and attached rails 106) is achieved through the horizontal stroke of another hydraulic cylinder 134 (FIG. 6) attached to the movable frame 120 and anchored to a fixed structural member of the part-handling apparatus above the surface of the fluid 88 held by the quench tank 50.

Figure 6:
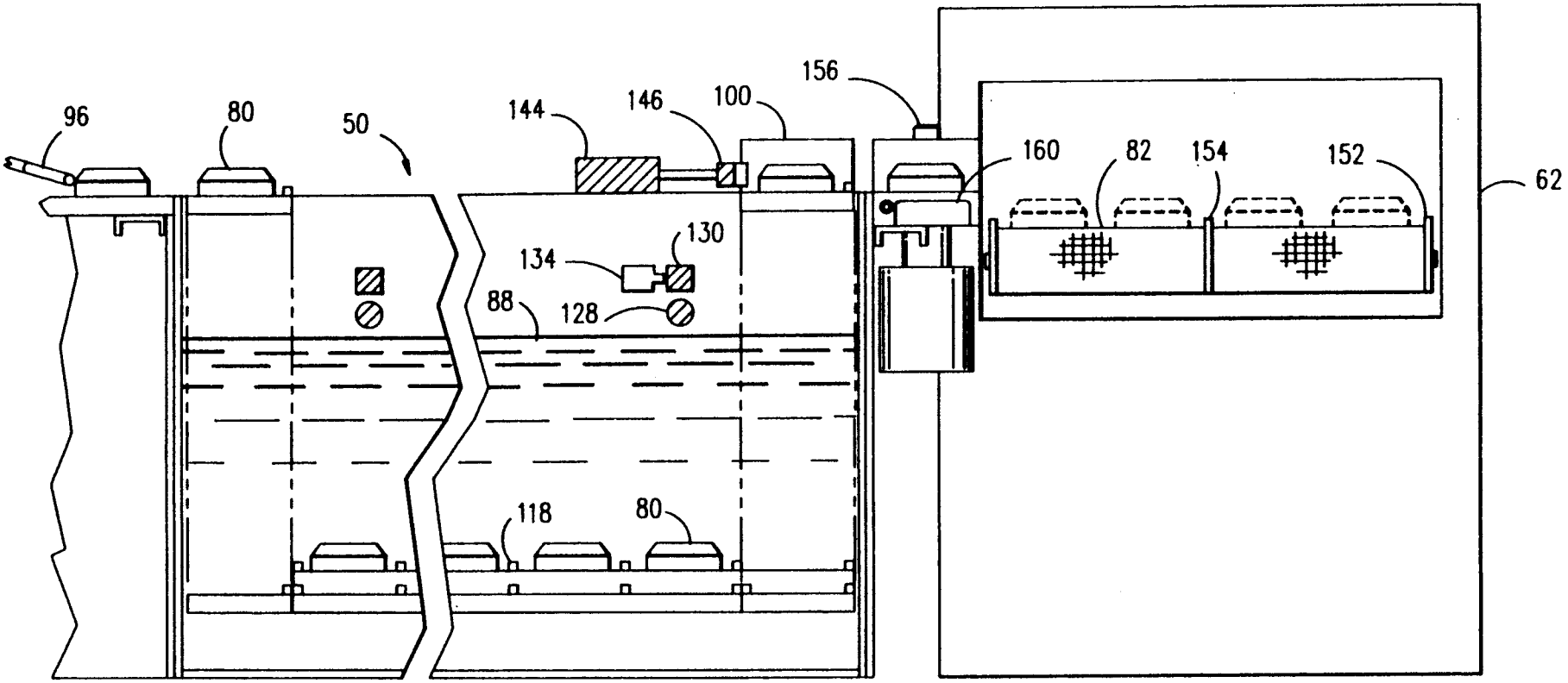
FIG. 6 is a side-elevational view of the part-handling apparatus taken along the line 6—6 of FIG. 3.

In order to permit the required amount of longitudinal motion of the movable rails 106, these rails 106 are necessarily shorter than the overall length of the quench tank 50. FIG. 6 shows a cross-sectional view of a preferred arrangement in which the movable rails 106 are of a length approximately equal to the overall length of the tank 50 less the length of the charge rails 84. The charge rails 84 and discharge rails 102 are typically of substantially equal lengths while the stationary rails 110 are of a length about equal to the length of the tank 50 less the combined lengths of the elevator rails 84 and 102.

As the charge rails 84 lower parts 80 toward the bottom of the quench tank 50, the movable rails 106 of the walking beam system 76 are moved backward in a generally horizontal or longitudinal motion towards the charge end of the quench tank 50 to a position directly below the charge rails 84. When the charge rails 84 have descended to their lowest point the movable rail frame 120 lifts the movable rails 106 up through the charge rails 84, thereby transferring the parts 80 from the charge elevator 70 to the movable rails 106.

Once the movable rails 106 have picked up the parts 80 by rising to a level higher than the charge rails 84 the movable rail frame 120 is operated to translate the movable rails 106 forward until the parts 80 are positioned over the stationary rails 110. At this point the movable rails 106 are lowered by the frame 120 to pass through the stationary rails 110, thereby transferring the parts 80 to the stationary rails 110.

After depositing the parts 80 onto the stationary rails 110, the movable rails 106 continue downward to a position slightly below the stationary rails 110. (Meanwhile, the charge elevator 70 is being raised to receive more parts 80 from the quench press 46 and is being lowered to provide the parts for pickup by the movable rails 106). The rails 106 then travel backward toward the charge end of the quench tank 50. Upon reaching the end of their backward stroke, the movable rails 106 again are raised by the frame 120 to pick up additional parts 80 from the charge rails 84 and also again pick up parts 80 positioned along the stationary rails 110. The movable rails 106 then provide a forward stroke, and the entire cycle is repeated.

To prevent the parts 80 from moving laterally as they are "walked" along the bottom of the tank 50, lane dividers 140 attached through plates 111 to transverse members 112 (FIG. 4) are provided to separate the stationary rails 110 into groups or lanes in a manner similar to the lanes of the elevator rails 84, 102. The lane dividers 140, together with the tabs 118 which prevent longitudinal movement, help ensure that the parts 80 move along the length of the tank 50 without experiencing any part-to-part contact.

The movable rails 106 may have a vertical stroke of approximately one inch centered at the top of the stationary rails 110, while the horizontal stroke may be approximately eight inches. Accordingly, during one cycle of the movable rails 106, parts are transferred from one eight-inch pocket to the next pocket.

Upon nearing the end of the stationary rails 110 adjacent to the discharge elevator 74, parts 80 are lifted off the stationary rails 110 by the movable rails 106 and, and in a manner opposite to that by which the charge elevator 70 is unloaded, are deposited onto the discharge rails 102. That is, the movable rails 106 will, on their descending stroke, mesh through the discharge rails 102 to a point below the discharge rails 102, thereby transferring the parts 80 onto the discharge elevator 74. Upward movement of the discharge rails 102 will raise the parts up out of the fluid in the quench tank 50.

Upon reaching the top of travel of the discharge elevator 74, parts 80 are removed from the discharge rails 102, as by action of a push-off device 144 mounted above the quench fluid and having V-grooved pusher heads 146. If a washer 62 and/or temper furnace 66 are "in-line" with the quench tank 50 in a manner similar to that illustrated in FIG. 1, then the parts may be pushed directly onto a conveyor 58 to be carried to the washer 62.

Alternatively, if the washer 62 is arranged with a travel direction at an angle to that of the longitudinal axis of the quench tank 50 (FIGS. 2 and 3), the parts are pushed onto a rotatable arm 150 mounted substantially even with the topmost position of the discharge rails 102 and slightly above the washer conveyor 82—i.e., sufficiently above the conveYor 82 that the arm 150 can clear the side guides 152 and the center guide 154 (if provided) of the conveyor 82 when the arm is rotated into position over the conveyor 82. The arm 150, one end of which is supported for rotation, as about a vertical shaft 156, is operable to rotate about the shaft 156 as by action of a drive motor 158 and appropriate gearing, an angular amount equivalent to the angle between the longitudinal axes of the quench tank 50 and the washer conveyor 82. For example, in the arrangement illustrated in FIGS. 2 and 3 the washer 62, or temper furnace 62 if no washer is needed ahead of the temper furnace, is positioned at a ninety-degree angle to the quench tank 50, which may provide better utilization of floor space in a plant in which the furnace system is installed. In this embodiment the rotatable arm 150, after accepting the parts 80 from the discharge rails 102, is rotated through a ninety-degree arc. After completion of the rotation, one end of a hinged trap door 160 in the arm 140 is triggered to lower so that parts 80 slide gently down along the door 160 and onto the washer conveyor 58. Thereafter the trap door 160 is retracted and the arm 150 rotated back into position adjacent to the quench tank for receipt of additional parts.

As illustrated in FIGS. 2 and 3, the rotatable arm 150 may have lane dividers 162 attached to its upper surface and aligned with the lane dividers 100 of the discharge elevator 74. The arm lane dividers 162 prevent lateral movement of parts 80, and thus part-to-part contact, as the parts are pushed onto the arm 150 and then rotated and transferred to the conveyor 82.

In one typical embodiment, the quench tank 50 is approximately 12 feet long by 6 feet wide. The quench tank is filled with approximately 18 inches of water through which the parts are walked along the tops of stationary rails 110 approximately 9 inches below the top surface of the water. The walking beam 76 travels through a complete cycle in about 18 seconds, advancing the parts eight inches per cycle so that the parts 80 have a residence time in the fluid of approximately 5 minutes. Altering the cycle time or stroke of the walking beam 76 or the dimensions of the quench tank 50 will, of course, alter the residence time of the parts 80 in the tank.

It is to be understood that the apparatus and method show and described herein are embodiments which are illustrative of the present invention and the invention is not limited to those disclosed. The invention is defined by the claims which follow and includes all embodiments and equivalents within the scope of those claims.

What is claimed is:

1. Part-handling apparatus for transporting metal parts along a travel path of a continuous heat-treating furnace system while avoiding contact between the parts and without carrying the parts in trays or containers, comprising:

a tank for containing cooling fluid to a selected level;

a charge elevator mounted at a first end of said tank and including a plurality of spaced charge rails extending parallel to the longitudinal axis of the tank for supporting said parts and also including means for moving said rails vertically between a first position above said selected level and a second position below said selected level;

a discharge elevator mounted at a second end of said tank and including a plurality of spaced discharge rails parallel to said charge rails for supporting said parts and also including means for moving said discharge rails vertically between a third position below said selected level and a fourth position above said selected level;

a plurality of spaced stationary rails extending parallel to said charge rails and located near said second position, said stationary rails extending along the tank between said charge rails and said discharge rails;

a plurality of movable rails parallel to said charge rails and being meshable with said charge rails, said discharge rails, and said stationary rails;

means for cycling said movable rails to alternately move vertically and horizontally in a manner to transport parts from said charge rails at said second position to said discharge rails at said third position, the vertical portion of the travel path of the movable rails extending from below to above the top of said stationary rails;

means for moving parts onto said charge rails at said first position; and means for removing parts from said discharge rails at said fourth position.

2. The part-handling apparatus as set forth in claim 1 wherein said means for cycling said movable rails includes a first frame assembly rigidly mounted above said tank and a movable frame supported by, and extending downward from, said first frame assembly, said movable frame including at least one generally horizontal member extending across a substantial portion of the width of said tank and being rigidly connected to said movable rails.

3. The part-handling apparatus as set forth in claim 1 further comprising a plurality of rail lane dividers extending along said charge rails, discharge rails, and stationary rails and separating the charge rails, discharge rails, and stationary rails into groups forming individual lanes defining longitudinal travel paths for the parts, said rail lane dividers preventing contact between parts through lateral movement of the parts across said charge rails, discharge rails, or stationary rails.

4. The part-handling apparatus as set forth in claim 1 wherein the upward facing surfaces of said movable rails and said stationary rails include tabs at spaced intervals greater than the length of said parts to prevent longitudinal movement of the parts along said movable and stationary rails so as to avoid contact between parts.

5. The part-handling apparatus as set forth in claim 1 wherein said second and third positions are at substantially the same height in the tank.

6. The part-handling apparatus as set forth in claim 5 including a conveyor positioned adjacent to the discharge end of said tank and below the height of said fourth position, and wherein said means for removing the parts from said discharge rails comprises a pusher operable to push parts from said discharge rails directly onto said conveyor.

7. The part-handling apparatus as set forth in claim 1 including a conveyor positioned near the discharge end of said tank and below the height of said fourth position, said conveyor having a longitudinal axis intersecting the longitudinal axis of said tank at a selected angle, and further including a rotatable arm operable to rotate substantially horizontally through an arc equivalent to said selected angle between a first arm position near the discharge end of said tank and at which said arm may receive parts pushed from said discharge rails and a second arm position near said conveyor and at which said arm may deliver parts to said conveyor.

8. The part-handling apparatus as set forth in claim 7 including a plurality of rail lane dividers extending along said charge rails, discharge rails, and stationary rails and separating the charge rails, discharge rails, and stationary rails into groups forming individual lanes defining longitudinal travel paths for the parts, and further including a plurality of arm lane dividers mounted on said rotatable arm and aligned with said rail lane dividers when said rotatable arm is in said first arm position.

9. The part-handling apparatus as set forth in claim 7 wherein said rotatable arm includes at least one hinged trap door operable to release and to deliver parts to said conveyor by sliding action along the door when said rotatable arm is in said second arm position.

10. A method of transporting a plurality of parts along a travel path in a continuous furnace system into, through, and out of a tank containing fluid for cooling the parts, while avoiding contact between the parts and without carrying the parts in trays or containers, comprising:

(i) providing at a first end of the tank a charge elevator having a plurality of charge rails extending parallel to the longitudinal axis of the tank and having dividers parallel to said rails to form lanes;

(ii) providing at a second end of the tank a discharge elevator formed of a plurality of discharge rails extending parallel to said charge rails;

(iii) loading a maximum of one part into each of said lanes while said charge rails are at a level near the top of said tank;

(iv) lowering said charge rails with said parts to a level at which the parts are submerged in the fluid;

(v) lifting the parts from the charge rails with a Plurality of spaced movable rails constructed to be meshable with the charge rails;

(vi) advancing the movable rails, and thereby the parts contained thereon, toward a second end of the tank;

(vii) lowering the movable rails to deposit the parts onto a plurality of spaced stationary rails constructed to be meshable with said movable rails;

(viii) raising said charge rails to said level near the top of the tank;

(ix) repeating steps (iii) through (viii) cyclically to advance parts along the length of said tank from said charge rails to said discharge rails positioned at substantially the level of said stationary rails;

(x) raising said discharge rails to lift parts out of said fluid; and (xi) transferring the parts out of said tank to a conveyor near said second end.

11. The method as set forth in claim 10 wherein said conveyor is in line with the longitudinal axis of the tank and step (xi) comprises pushing said parts from said discharge rails onto said conveyor.

12. The method as set forth in claim 11 wherein said conveyor has a longitudinal axis intersecting the longitudinal axis at a preselected angle, and step (xi) comprises the substeps of (a) pushing said parts from said discharge rails onto a rotatable arm, (c) rotating said arm through an arc equivalent to said preselected angle, and (c) transferring said Parts from said arm to said conveyor.

13. The method as set forth in claim 12 wherein step (c) comprises opening a hinged trap door in said arm and allowing said parts to slide gently along the sloped portion of said door.

* * * * *